US007771235B2

(12) United States Patent
Kameyama

(10) Patent No.: US 7,771,235 B2
(45) Date of Patent: Aug. 10, 2010

(54) SHIELDED CONNECTOR WITH AN INNER SHIELD TIGHTLY FITTED INTO AN OUTER SHIELD

(75) Inventor: Isao Kameyama, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/484,266

(22) Filed: Jun. 15, 2009

(65) Prior Publication Data

US 2009/0318025 A1 Dec. 24, 2009

(30) Foreign Application Priority Data

Jun. 16, 2008 (JP) ..... 2008-156536

(51) Int. Cl.
*H01R 13/648* (2006.01)

(52) U.S. Cl. ..... 439/607.27

(58) Field of Classification Search ..... 439/607.27, 439/607.45, 607.55, 607.09
See application file for complete search history.

(56) References Cited

U.S. PATENT DOCUMENTS

| | | | | |
|---|---|---|---|---|
| 6,793,531 | B1 * | 9/2004 | Zhang | 439/607.04 |
| 6,863,569 | B2 * | 3/2005 | Zhu et al. | 439/607.27 |
| 6,935,896 | B1 * | 8/2005 | Tsai | 439/607.27 |
| 7,168,985 | B1 * | 1/2007 | Zhang et al. | 439/607.23 |
| 2005/0197011 | A1 * | 9/2005 | Tsai | 439/607 |
| 2009/0209130 | A1 * | 8/2009 | Kameyama et al. | 439/607.27 |
| 2009/0253295 | A1 * | 10/2009 | Kameyama et al. | 439/607.27 |

* cited by examiner

*Primary Examiner*—Chandrika Prasad
(74) *Attorney, Agent, or Firm*—Sughrue Mion, PLLC

(57) ABSTRACT

A shield connector includes a housing that has a metal terminal, a conductive inner shield shell that contains the housing, and a conductive outer shield shell that contains the inner shield shell. The inner shield shell includes a first shell body in a tubular shape for covering an outer face of the housing. The outer shield shell includes a second shell body in a tubular shape, and a fixing portion which fixes the inner shield shell. The fixing portion has an annular wall which is formed inside of the second shell body along in a circumferential direction of the second shell body. An inner face of the annular wall is tightly face-contacted on an outer face of the first shell body of the inner shield shell over an entire circumference of the outer face of the first shell body.

4 Claims, 4 Drawing Sheets

SHIELDED CONNECTOR WITH AN INNER SHIELD TIGHTLY FITTED INTO AN OUTER SHIELD

BACKGROUND

The present invention relates to a shield connector which is used for electrically interconnecting electronic appliances mounted on an automobile or the like, for example.

A plurality of electronic appliances are mounted on the automobile as a movable body. Therefore, for the purpose of transmitting electric power and signals to these electronic appliances, wire harnesses are arranged in the automobile. The wire harnesses are provided with a plurality of electric wires and connectors.

The electric wire is a so-called shielded wire including a core wire having electric conductivity and a shielding part formed of insulating synthetic resin for shielding this core wire. As the connector, shield connectors of various types such as a shield connector 700 (exemplified in FIGS. 5 to 7), for example, have been heretofore used.

The shield connector 700 as shown in FIGS. 5 to 7 is superposed on a printed wiring board and fixed to the relevant printed wiring board. The shield connector 700 includes an inner housing 701 formed of insulating synthetic resin, a plurality of terminal metals 702 which are fitted to the inner housing 701, and an inner shield shell 703 formed of conductive metal, an outer housing 704 formed of insulating synthetic resin, and an outer shield shell 705 formed of conductive metal.

The inner housing 701 is formed in a substantially quadrangular pillar shape. The terminal metal 702 is formed of conductive metal in a rod-like shape. One end portion 702*a* of the terminal metal 702 is arranged so as to pass through the inner housing 701, and the other end portion 702*b* is bent at a substantially right angle from the one end portion 702*a* to be arranged outside of the inner housing 701.

The inner shield shell 703 is obtained by folding a sheet metal. The inner shield shell 703 is integrally provided with a shell body 706 which contains therein the inner housing 701 in such a manner that its inner face is tightly superposed on an outer face of the inner housing 701, and a fixing piece 707 which is erected from the shell body 706 and adapted to be fixed to a pattern of conductors on the printed wiring board and so on.

The outer housing 704 is formed in a quadrangular tubular shape for containing the inner shield shell 703. The outer housing 704 is provided with a wall part 704*a* at a position close to its one end at an opposite side to an end with which a mating connector is engaged. The wall part 704*a* is provided with an opening along an outer periphery of the inner shield shell 703, so that the inner shield shell 703 is press-fitted into this opening thereby to be fixed inside the outer housing 704.

The outer shield shell 705 is obtained by folding a sheet metal. The outer shield shell 705 is integrally provided with a shell body 708 which contains therein the outer housing 704 in such a manner that its inner face is tightly superposed on an outer face of the outer housing 704, a pair of elastic contact pieces 709 which are internally erected from the shell body 708 and brought into elastic contact with the inner shield shell 703, and a plurality of fixing pieces 710 which are erected from the shell body 708 and adapted to be fixed to the pattern of the conductors on the printed wiring board and so on.

The shield connector 700 as described above is engaged with the mating connector, and at the same time, introduces electrical noise which is going to leak to the exterior from the terminal metals 702 and electrical noise which is going to enter into the terminal metals 702 from the exterior, to an earth circuit, from the inner shield shell 703 and the outer shield shell 705, respectively through the fixing piece 707 of the inner shield shell, the fixing pieces 710 of the outer shield shell 705, and the pattern of the conductors on the printed wiring board.

It is to be noted that there is no information concerning a document of the prior art to be disclosed, because there has been no prior art that the applicant knows at a time of filing this patent application.

The inner shield shell 703 and the outer shield shell 705 are electrically connected to each other by a pair of the elastic contact pieces 709 which are provided at inside of the outer shield shell 705. Then, due to this connection, electric current which flows through respective surfaces of the shield shells 703, 705 together with occurrence of noises flows from one of the shield shells to the other shield shell by way of the elastic contact pieces 709.

The noise emitted from the electric power and signals of the electronic appliances includes a lot of high frequency signal components, and the high frequency signal has such property that it is unlikely to flow, in case where a surface area is small. In the above described shield connector 700, because the inner shield shell 703 and the outer shield shell 705 are electrically connected by means of the elastic contact pieces 709, a contact area between them is very small (In short, the surface area is small). For this reason, the electric current together with the noise cannot efficiently flow between the shield shells 703 and 705, and a potential difference occurs on the respective surfaces of the shield shells 703, 705, which results in deflected distribution of the electric current. Accordingly, there has been such a problem that the noise (electromagnetic wave) caused by this deflected distribution of the electric current is emitted to the exterior of the shield shells 703, 705.

SUMMARY

An object of the invention is to solve the above described problem. Specifically, it is an object of the invention to provide, at a low cost, a shield connector in which deflected distribution of electric current occurring in shield shells can be prevented.

In order to achieve the above object, according to the present invention, there is provided a shield connector, comprising:

a housing that has a metal terminal;

a conductive inner shield shell that contains the housing; and a conductive outer shield shell that contains the inner shield shell, wherein the inner shield shell includes a first shell body in a tubular shape for covering an outer face of the housing;

wherein the outer shield shell includes a second shell body in a tubular shape, and a fixing portion which fixes the inner shield shell;

wherein the fixing portion has an annular wall which is formed inside of the second shell body along in a circumferential direction of the second shell body; and wherein an inner face of the annular wall is tightly face-contacted on an outer face of the first shell body of the inner shield shell over an entire circumference of the outer face of the first shell body.

Preferably, the inner face of the annular wall is tightly face-contacted on a ring-like circumference portion of the outer face of the first shell body of the inner shield shell.

Preferably, the inner shield shell is press-fitted into the annular wall of the fixing portion so that the inner shield shell is fixed to the outer shield shell.

Here, it is preferable that the annular wall is formed so that a sectional area of a space enclosed with the annular wall is gradually reduced in a direction of press-fitting the inner shield shell into the annular wall.

According to the above configuration, the outer shield shell has the fixing portion provided with the annular wall which is tightly face-contacted on an outer face of the first shell body of the inner shield shell over an entire circumference thereof. Therefore, it is possible to bring the annular wall, which is a part of the outer shield shell, into contact with the outer face of the first shell body of the inner shield shell over the entire circumference thereof. Moreover, it is possible to fix the inner shield shell inside the outer shield shell by means of the fixing portion provided with the annular wall.

Also, according to the above configuration, the shield connector can be easily assembled, because the inner shield shell is fixed to the outer shield shell by being press-fitted into the annular wall.

Also, according to the above configuration, the shape of the annular wall is simple, because the annular wall is formed so that the sectional area of the space enclosed with the annular wall is gradually reduced.

As described above, according to the above configurations, the contact area between the outer shield shell and the inner shield shell can be increased, because the annular wall, which is a part of the outer shield shell, can be brought into contact with the outer face of the first shell body of the inner shield shell over the entire circumference thereof. Accordingly, it is possible to efficiently flow the electric current between these shield shells, and to prevent deflected distribution of the electric current on the surfaces of the shield shells, thereby to decrease emission of noises (electromagnetic wave).

Moreover, because the inner shield shell can be fixed to the outer shield shell by the fixing portion provided with the annular wall, a fixing member such as an outer housing for fixing the inner shield shell to the outer shield shell is not required, and hence, production cost can be reduced.

Also, according to the above configurations, because the shield connector can be easily assembled, by press-fitting the inner shield shell into the annular wall thereby to be fixed to the outer shield shell, the production cost can be reduced.

According to the above configurations, because the annular wall is formed in a simple shape, the sheet metal or the like can be easily worked, and hence, the production cost can be reduced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1:
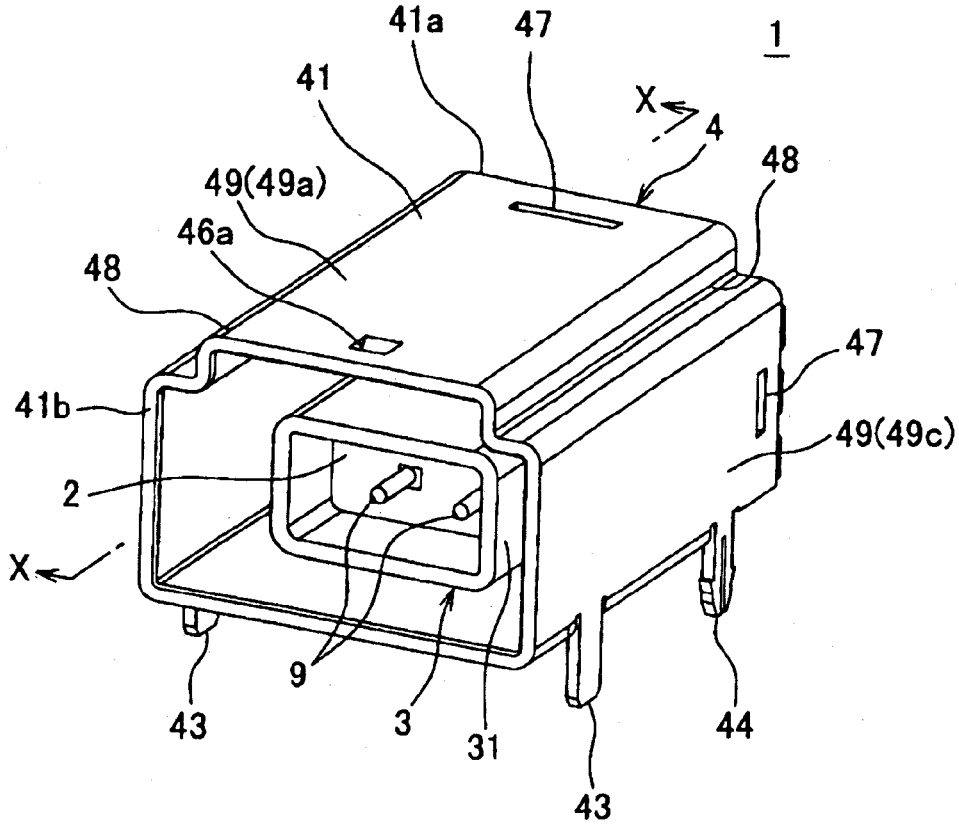
FIG. 1 is a perspective view of a shield connector according to an embodiment of the invention.

Now, a shield connector showing an embodiment of the invention will be described referring to FIGS. 1 to 4. A shield connector 1 as shown in FIG. 1 and so on is fitted to a printed wiring board which is not shown, and engaged with a mating connector provided in a wire harness, which is not shown, to be installed on an automobile. Then, the shield connector 1 supplies required electric power, signals and so on to various types of electronic appliances.

The printed wiring board to which this shield connector is fitted includes a board formed of insulating synthetic resin and a circuit pattern formed on this board, which is not shown. The board is formed in a shape of a flat plate. Electronic components of various types, which are not shown, are mounted on the board. The circuit pattern is formed of conductive metal such as copper, into a foil (in a shape of a film), and bonded to a surface of the board. The circuit pattern electrically interconnects the electronic components which are mounted on the board according to a determined pattern. Further, a part of the circuit pattern is electrically connected to an earth circuit of the automobile.

As shown in FIG. 1 and so on, the shield connector 1 includes a housing 2, an inner shield shell 3, an outer shield shell 4, and a plurality of terminal metals 9.

Figure 2:
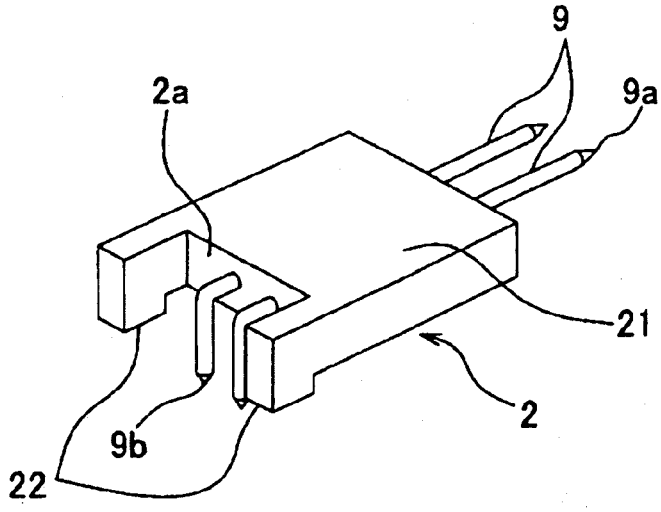
FIG. 2 is a perspective view of a housing which is provided in the shield connector in FIG. 1.
Figure 3:
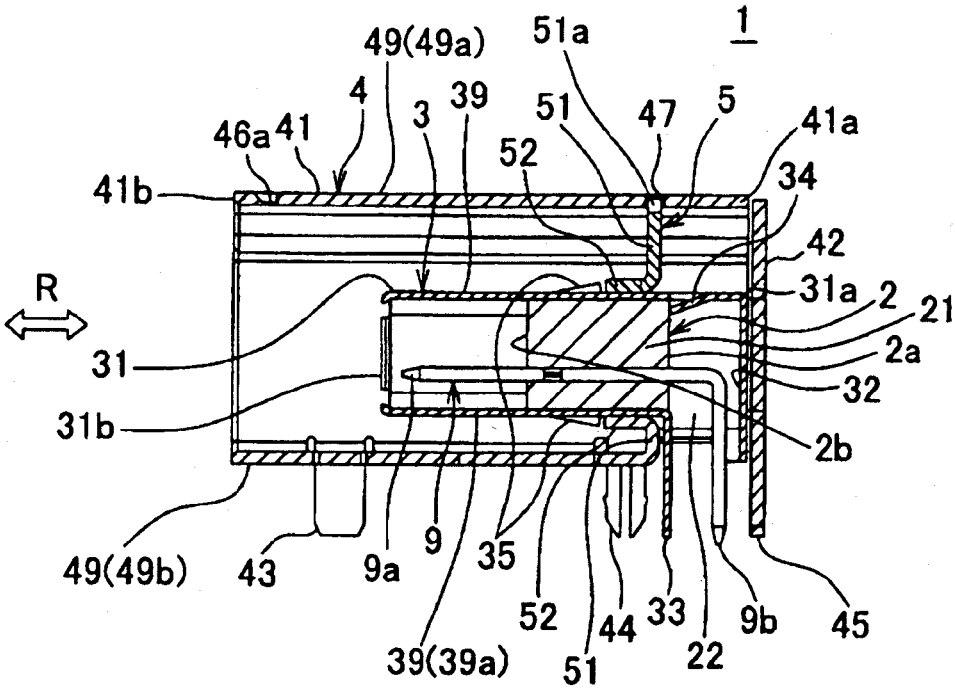
FIG. 3 is a sectional view taken along a line X-X in FIG. 1.

The housing 2 includes a body part 21 which is formed of insulating synthetic resin or the like, in a quadrangular pillar shape as shown in FIG. 2 and so on, and a pair of leg portions 22 which are erected from opposed peripheral edges of one face 2*a* of the body part 21. The leg portions 22 of the housing 2 are formed in a substantially L-shape as seen from a side face, and adapted to come into contact with an end part of a peripheral wall 39 of the inner shield shell 3 thereby to position the housing 2, when the housing 2 is press-fitted into the inner shield shell 3 which will be described below. A plurality of the terminal metals 9 are respectively formed of conductive metal, and formed in a shape of a round rod which is bent in an L-shape as seen from a side face, as shown in FIG. 3. A plurality of the terminal metals 9 are arranged in parallel with one another. Moreover, one end portion 9*a* of each of the terminal metals 9 is so arranged as to pass through a pair of faces 2*a*, 2*b* of the body part 21 of the housing 2 which are opposed along a direction R of inserting and extracting the connector. In short, the terminal metal 9 passes through the housing 2 to be held by the housing 2. Further, the other end portion 9*b* of the terminal metal 9 is so arranged as to extend to the exterior of the shield connector 1. The other end portions 9*b* of a plurality of the terminal metals 9 are fixed to the circuit pattern of the printed wiring board by soldering or so.

The inner shield shell 3 is formed by folding a conductive sheet metal, after it has been punched out into a determined shape. The inner shield shell 3 includes a shell body 31, a back face shell 32, a fixing piece 33, and a plurality of retaining claws 34, 35.

The shell body 31 is formed in a quadrangular tubular shape and provided with a plurality of peripheral walls 39 which are continued to each other. The shell body 31 is superposed on an outer peripheral face of the body part 21 of the housing 2 (that is, four faces perpendicular to a pair of the faces 2*a*, 2*b*), thereby to contain therein the housing 2 and a plurality of the terminal metals 9. Inside the shell body 31, the housing 2 is arranged close to one end 31*a* of the shell body 31, and the one end portions 9*a* of a plurality of the terminal metals 9 are arranged close to the other end 31*b* of the shell body 31.

The back face shell 32 is formed in a shape of a flat plate. The back face shell 32 is formed by being bent from the shell body 31 so as to be continued from the one end 31*a* of the shell body 1, and so as to be perpendicular to the respective peripheral walls 39 of the shell body 31. The other end portions 9*b* of a plurality of the terminal metals 9 are positioned between the back face shell 32 and one face 2*a* of the housing 2. Moreover, the shell body 31 and the back face shell 32 are fixed to each other by a fixing member (for example, fixing claws, fixing hole, etc.), which are not shown.

The fixing piece 33 is formed by being bent outwardly from the shell body 31 so as to be perpendicular to one of the peripheral walls 39 (hereinafter, represented by numeral 39*a*). The fixing piece 33 is fixed to the circuit pattern of the printed wiring board by soldering or so, and electrically connected to the earth circuit of the automobile.

A plurality of the retaining claws 34, 35 are formed by folding respective inner parts of U-shaped slits which are formed in the peripheral wall 39 of the shell body 31, so as to protrude from the relevant peripheral wall. The retaining claw 34 is positioned close to the one end 31*a* of the shell body 31 so as to protrude inward of the shell body 31 in a direction toward the other end 31*b*, and engaged with the one face 2*a* of the housing 2 thereby to prevent the housing 2 from dropping from the inner shield shell 3. The retaining claws 35 are positioned at a substantially center of the shell body 31 so as to protrude outward of the shell body 31 in a direction toward the one end 31*a*, and engaged with a fixing portion 5 of the outer shield shell 4, which will be described below, thereby to prevent the inner shield shell 3 from dropping from the fixing portion 5.

The outer shield shell 4 is formed by folding a conductive sheet metal, after it has been punched out into a determined shape. The outer shield shell 4 includes a shell body 41, a back face shell 42, fixing pieces 43, 44, 45, and the fixing portion 5.

The shell body 41 is formed in a quadrangular tubular shape and provided with a plurality of peripheral walls 49 which are continued to each other. A pair of corner parts 48 which are opposed to each other interposing one of the peripheral walls 49 (hereinafter, represented by numeral 49*a*) of the shell body 41 are respectively formed in a step-like shape. The shell body 41 contains therein the inner shield shell 3 in such a manner that the shell body 31 is in parallel with the peripheral walls 49. The shell body 41 is fixed to the printed wiring board by superposing another peripheral wall 49 (hereinafter, represented by numeral 49*b*) which is opposed to the one peripheral wall 49*a*, on the printed wiring board. A length of the other one peripheral wall 49*b* along the direction R of inserting and extracting the connector is made shorter than the other peripheral walls 49.

Moreover, the shell body 41 is provided with the fixing pieces 43, 44 which are protruded from lower ends of a pair of the peripheral walls 49 (hereinafter, represented by numeral 49*c*) interconnecting the one peripheral wall 49*a* and the other one peripheral wall 49*b*, in a direction along their surfaces. These fixing pieces 43, 44 are fixed to the circuit pattern of the printing wiring board by soldering or so, to be electrically connected to the earth circuit of the automobile. Further, the shell body 41 is provided with a lock hole 46*a* near the other end 41*b*. When the mating connector is engaged with the shield connector 1, a lock claw or the like of the mating connector is engaged with this lock hole 46*a*, thereby to prevent disengagement of the connector.

The back face shell 42 is formed in a shape of a flat plate. The back face shell 42 is formed by being bent from the shell body 41 so as to be continued from the one end 41*a* of the shell body 41, and so as to be perpendicular to the peripheral walls 49 of the shell body 41. The back face shell 42 is so arranged as to be superposed on the back face shell 32 of the inner shield shell 3. The back face shell 42 is provided with a pair of fixing pieces 45 which are protruded from one end thereof in a direction along its surface. These fixing pieces 45 are fixed to the circuit pattern of the printed wiring board by soldering or so, and electrically connected to the earth circuit of the automobile. Moreover, the shell body 41 and the back face shell 42 are fixed to each other, by engaging a fixing claw, which is not shown, provided on a fixing piece 42*a* with a fixing hole 46*b* formed in one of the peripheral walls 49*c*.

The fixing portion 5 is provided at a position close to the one end 41*a* of the shell body 41, and formed by being bent from the shell body 41 so as to be continued from an end of the peripheral wall 49*b* of the shell body 41, and so as to be perpendicular to the respective peripheral walls 49. The fixing portion 5 includes a flat plate part 51 and an annular wall 52.

The flat plate part 51 is a part having a shape of a flat plate which is perpendicular to the respective peripheral walls 49. An outer edge of the flat plate part 51 has substantially the same shape as a cross sectional shape of the shell body 41. A part of the outer edge of the flat plate part 51 is continued from the peripheral wall 49*b*. A plurality of protuberances 51*a* which are protruded in a direction along a surface of the flat plate part 51 are provided on the other part of the outer edge of the flat plate part 51. By engaging these protuberances 51*a* with fixing holes 47 which are formed in the peripheral walls 49*a*, 49*c* of the shell body 41, the flat plate part 51 (that is, the fixing portion 5) and the shell body 41 are fixed to each other. The flat plate part 51 is provided with an opening having the same shape as a sectional area of the inner shield shell 3.

The annular wall 52 is a wall part in a quadrangular tubular shape which is continued from an inner edge (that is, an edge of the opening) of the flat plate part 51 and protruded in a direction toward the other end 41*b* of the shell body 41. The annular wall 52 is formed by punching out from a sheet metal. The annular wall 52 is formed substantially in parallel with the respective peripheral walls 49 of the shell body 41. Moreover, the annular wall 52 has a taper shape in which its circumference becomes gradually smaller in a direction from its one end continued from the flat plate part 51 to the other end (that is, a distal end) (In other words, a sectional area of a space enclosed by the annular wall 52 is gradually reduced). The inner shield shell 3 is press-fitted into the annular wall 52, and an inner face of the annular wall 52 is tightly superposed on outer faces of the peripheral walls 39 of the inner shield shell 3 over an entire circumference thereof. It is to be noted that a taper angle of the annular wall 52 is very small in fact, and it would be sufficient that the taper angle is to such an extent that the inner shield shell 3 can be fixed, when it has been press-fitted.

Although in this embodiment, the annular wall 52 is formed in the taper shape, its shape is not limited to this. The shape can be optionally selected, provided that the inner shield shell 3 can be press-fitted and fixed to the annular wall 52. For example, a drum shape in which a center part of the annular wall 52 is formed smaller than both end parts may be adopted. The annular wall 52 preferably has such a shape that a contact area with respect to the inner shield shell 3 can be increased.

Then, a method of assembling the shield connector 1 will be described referring to FIG. 4.

The shield connector 1 having the above described structure is assembled in the following manner. As a first step, a plurality of the terminal metals 9 are fitted to the housing 2. This housing 2 is press-fitted into the shell body 31 of the inner shield shell 3 from the one end 31*a* of the shell body 31, until the one face 2*a* of the body part 21 is engaged with the retaining claw 34, and the leg portions 22 are brought into contact with an end of the peripheral wall 39*a* of the shell body 31 close to the one end 31*a*. Thereafter, the shell body 31 and the back face shell 32 are fixed to each other, thereby to contain the housing 2 inside the inner shield shell 3.

Figure 4:
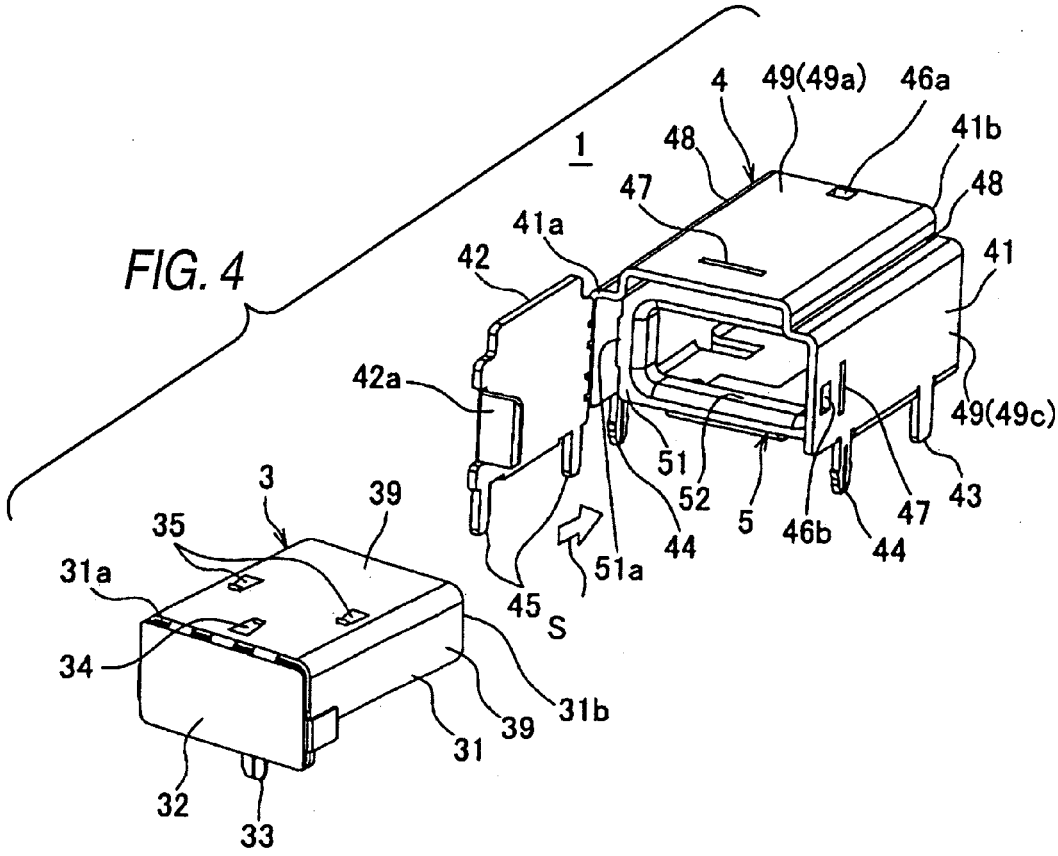
FIG. 4 is an exploded perspective view of the shield connector in FIG. 1.
Figure 5:
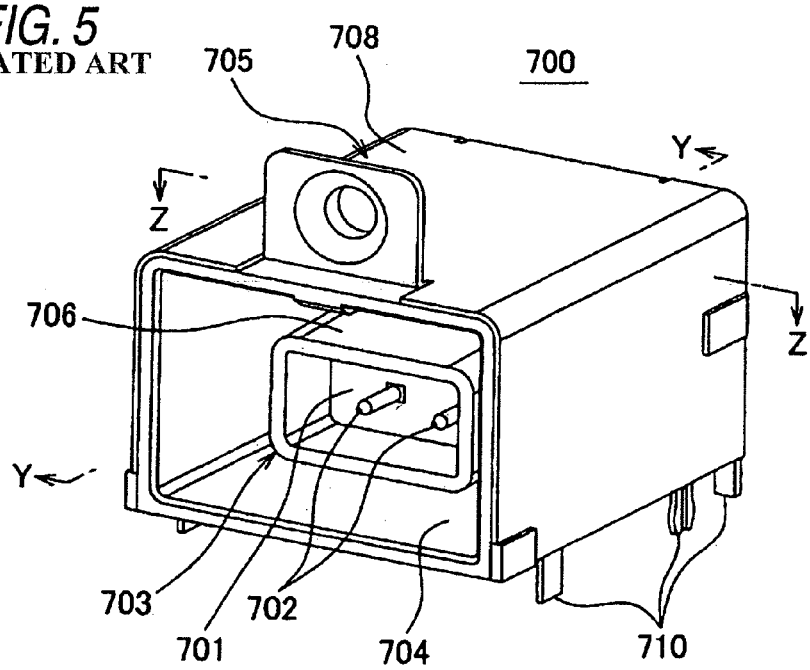
FIG. 5 RELATED ART
FIG. 5 is a perspective view showing a related shield connector.
Figure 6:
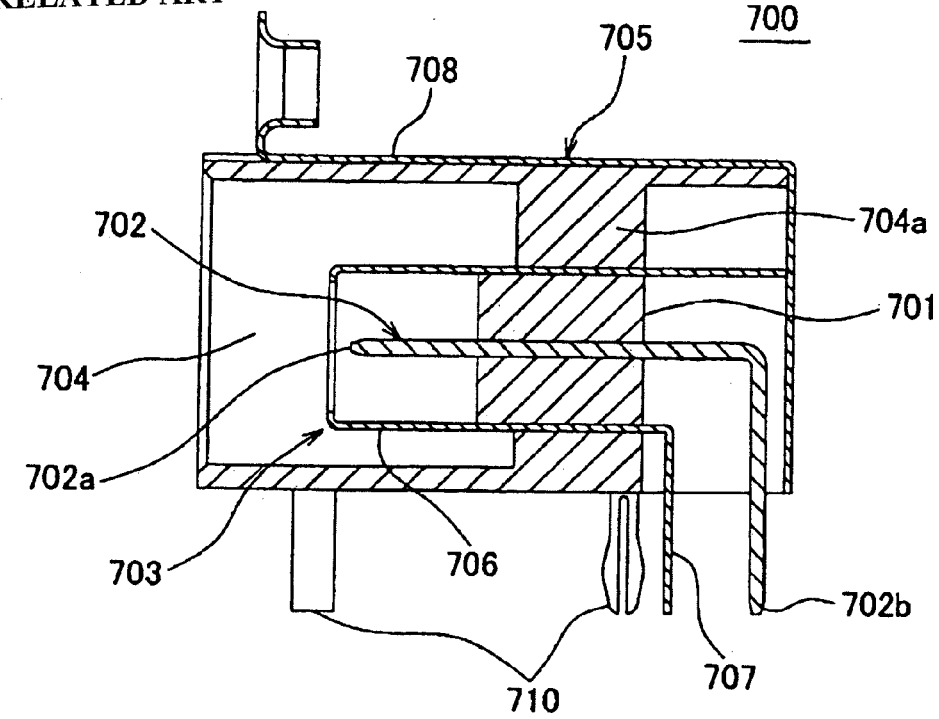
FIG. 6 RELATED ART
FIG. 6 is a sectional view taken along a line Y-Y in FIG. 5.
Figure 7:
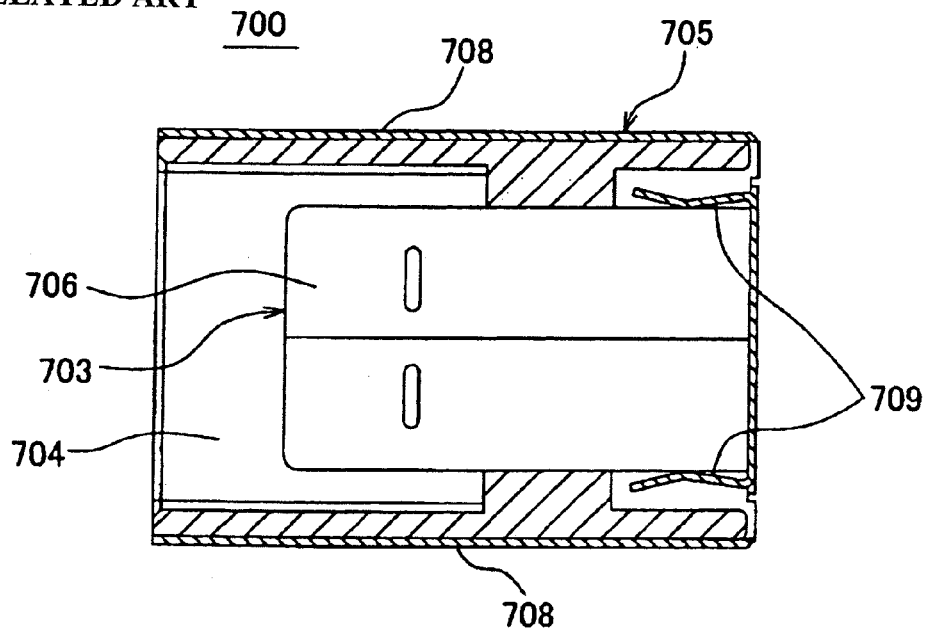
FIG. 7 RELATED ART
FIG. 7 is a sectional view taken along a line Z-Z in FIG. 5.

Then, as shown in FIG. 4, the inner shield shell 3 having the housing 2 contained therein is press-fitted into the shell body 41 from the one end 41*a* of the shell body 41 of the outer shield shell 4. Specifically, the other end 31*b* of the shell body 31 of the inner shield shell 3 is brought into contact with an inner edge of the flat plate part 51 of the fixing portion 5 of the outer shield shell 4, and the inner shield shell 3 is press-fitted into the annular wall 52 in a direction of S in FIG. 4, until the retaining claws 35 are engaged with the distal end of the annular wall 52. Then, the shell body 41 and the back face shell 42 are fixed to each other, by means of the fixing hole 46*b* of the shell body 41 and the fixing piece 42*a* of the back face shell 42, thereby to contain the inner shield shell 3 inside the outer shield shell 4. In this manner, the shield connector 1 is assembled. The shield connector 1 which has been thus assembled is superposed on the printed wiring board, and the other end portions 9*b* of the terminal metals 9 and the respective fixing pieces 33, 43, 44, 45 are fixed to the circuit pattern of the printed wiring board.

According to this embodiment, the outer shield shell 4 has the fixing portion 5 provided with the annular wall 52 which is tightly superposed on the outer faces of the peripheral walls 39 of the shell body 31 of the inner shield shell 3 over the entire circumference thereof. Therefore, it is possible to bring the annular wall 52, which is a part of the outer shield shell 4, into contact with the outer faces of the peripheral walls 39 of the shell body 31 of the inner shield shell 3 over the entire circumference thereof. Moreover, it is possible to fix the inner shield shell 3 inside the outer shield shell 4 by means of the fixing portion 5 provided with the annular wall 52.

Further, the shield connector 1 can be easily assembled, because the inner shield shell 3 is fixed to the outer shield shell 4 by being press-fitted into the annular wall 52.

Still further, the shape of the annular wall 52 is simple, because the annular wall 52 is formed in such a manner that the sectional area of the space enclosed by the annular wall 52 may be gradually reduced.

As described above, according to the invention, the contact area between the outer shield shell 4 and the inner shield shell 3 can be increased, because the annular wall 52, which is a part of the outer shield shell 4, can be brought into contact with the outer faces of the peripheral walls 39 of the shell body 31 of the inner shield shell 3 over the entire circumference thereof. Accordingly, it is possible to efficiently flow the electric current between these shield shells 3 and 4, and to prevent deflected distribution of the electric current on the surfaces of the shield shells 3, 4, thereby to decrease emission of noises (electromagnetic wave).

Moreover, because the inner shield shell 3 can be fixed to the outer shield shell 4 by means of the fixing portion 5 provided with the annular wall 52, a fixing member such as an outer housing for fixing the inner shield shell 3 to the outer shield shell 4 is not required, and hence, production cost can be reduced.

Further, because the shield connector 1 can be easily assembled, by press-fitting the inner shield shell 3 into the annular wall 52 thereby to be fixed to the outer shield shell 4, the production cost can be reduced.

Still further, because the annular wall 52 is formed in a simple shape, the sheet metal or the like can be easily worked, and hence, the production cost can be reduced.

Although in this embodiment, the shell body 31 of the inner shield shell 3 and the shell body 41 of the outer shield shell 4 are both formed in a quadrangular tubular shape, their shapes are not limited to this. The shapes of the shell bodies 31, 41 can be optionally selected, provided that functions as the shield connector are satisfied and the contact area between the shell bodies can be increased, according to the above described invention.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2008-156536 filed on Jun. 16, 2008, the contents of which are incorporated herein for reference.

What is claimed is:

1. A shield connector, comprising:

a housing that has a metal terminal;

a conductive inner shield shell that contains the housing; and a conductive outer shield shell that contains the inner shield shell, wherein the inner shield shell includes a first shell body in a tubular shape for covering an outer face of the housing;

wherein the outer shield shell includes a second shell body in a tubular shape, and a fixing portion which fixes the inner shield shell;

wherein the fixing portion has an annular wall which is formed inside of the second shell body along in a circumferential direction of the second shell body; and wherein an inner face of the annular wall is tightly face-contacted on an outer face of the first shell body of the inner shield shell over an entire circumference of the outer face of the first shell body.

2. The shield connector according to claim 1, wherein the inner shield shell is press-fitted into the annular wall of the fixing portion so that the inner shield shell is fixed to the outer shield shell.

3. The shield connector according to claim 2, wherein the annular wall is formed so that a sectional area of a space enclosed with the annular wall is gradually reduced in a direction of press-fitting the inner shield shell into the annular wall.

4. The shield connector according to claim 1, wherein the inner face of the annular wall is tightly face-contacted on a ring-like circumference portion of the outer face of the first shell body of the inner shield shell.

* * * * *